United States Patent [19]

Britcher, Jr.

[11] 4,069,861

[45] Jan. 24, 1978

[54] CONTINUOUS CASTING INSTALLATION INCLUDING TUNDISH CAR WITH TILTING CRADLE

[75] Inventor: Harry H. Britcher, Jr., Johnstown, Pa.

[73] Assignee: United States Steel Corporation, Pittsburgh, Pa.

[21] Appl. No.: 691,745

[22] Filed: June 1, 1976

[51] Int. Cl.[2] ..... B22D 11/10

[52] U.S. Cl. ..... 164/438; 105/275; 214/312; 222/604

[58] Field of Search ..... 164/281 R; 222/604; 214/312; 105/163 R, 272, 274, 275

[56] References Cited

U.S. PATENT DOCUMENTS

| | | | |
|---|---|---|---|
| 758,812 | 5/1904 | Bennetts et al. | 105/275 |
| 3,107,797 | 10/1963 | McFeaters et al. | 105/274 X |
| 3,844,429 | 10/1974 | Bode et al. | 164/281 X |

*Primary Examiner*—Robert D. Baldwin
*Attorney, Agent, or Firm*—Walter P. Wood

[57] ABSTRACT

A car for carrying large vessels, such as a tundish used in continuous casting, wherein the vessel is raised and lowered while supported on the car, and also can tilt to dump its contents. The car includes a vessel-supporting cradle which tilts from an upright position about an off-center axis located near the bottom and adjacent the side toward which the cradle tilts. Thus the contents of the vessel can be dumped without shifting the car from the position it occupies for teeming metal from a tundish into a mold. Jack screws, which raise and lower the vessel and support the weight, are stressed in tension.

5 Claims, 6 Drawing Figures

CONTINUOUS CASTING INSTALLATION INCLUDING TUNDISH CAR WITH TILTING CRADLE

This invention relates to an improved car for carrying large vessels which are required to be raised and lowered and on occasion their contents dumped while supported on the car.

The invention is particularly useful when embodied in a car used for carrying a tundish in a continuous-casting installation. In the continuous-casting art, a tundish is an intermediate refractory-lined vessel which receives liquid metal from a ladle and from which the metal is teemed into an open-ended mold. Commonly the tundish is carried to its teeming position or removed therefrom on a car which travels on rails on the casting floor. In many installations metal is teemed through a pouring tube as it goes from the tundish to the mold. The lower end of the pouring tube is submerged beneath the surface of the pool of metal in the mold. The tube must be replaced from time to time. Before replacing a tube while a casting operation is taking place, it is necessary to close the tundish outlet, and raise the tundish sufficiently that the tube clears the mold. After a new tube is installed and the tundish lowered, teeming can resume.

Most tundish cars also provide for tilting the tundish from its upright position to dump its contents at the end of a casting operation or in the event of a malfunction of the casting machine. Usually the tundish tilts about an axis near its upper edge midway of its width and, when the contents are to be dumped, the car and tundish are shifted to a position out of line with the mold where a suitable receiving receptacle is located. Reference can be made to Bode et al U.S. Pat. No. 3,844,429 of common ownership and in which I am a co-inventor for a showing. In some installations there is insufficient space on the casting floor to accommodate a receptacle in the usual location offset from the mold in the direction of car travel. In such installations the receptacle can be located only alongside the mold to receive material from the tundish while the car remains in its position for teeming. If the tundish tilts about an axis midway of its width, it cannot dump into a receptacle thus located.

An object of the present invention is to provide an improved tundish car which supports a tundish for tilting from its upright position about an axis near the bottom of the tundish unsymmetrical with the tundish width to enable the tundish to dump material into a receptacle located alongside and immediately adjacent a mold.

A more specific object is to provide an improved tundish car which includes a frame, a tiltable tundish-supporting cradle mounted on the frame for pivotal movement about an off-center axis near the bottom of the cradle adjacent the side toward which the cradle tilts, and fluid pressure means for tilting the cradle and tundish.

A further object is to provide an improved tundish car in which the tundish is supported on screw jacks for vertical movement, but in which, as distinguished from the car shown in the aforementioned patent, the screw jacks are in tension and the cradle and tundish hang therefrom for greater stability. In the drawings.

Figure 1:
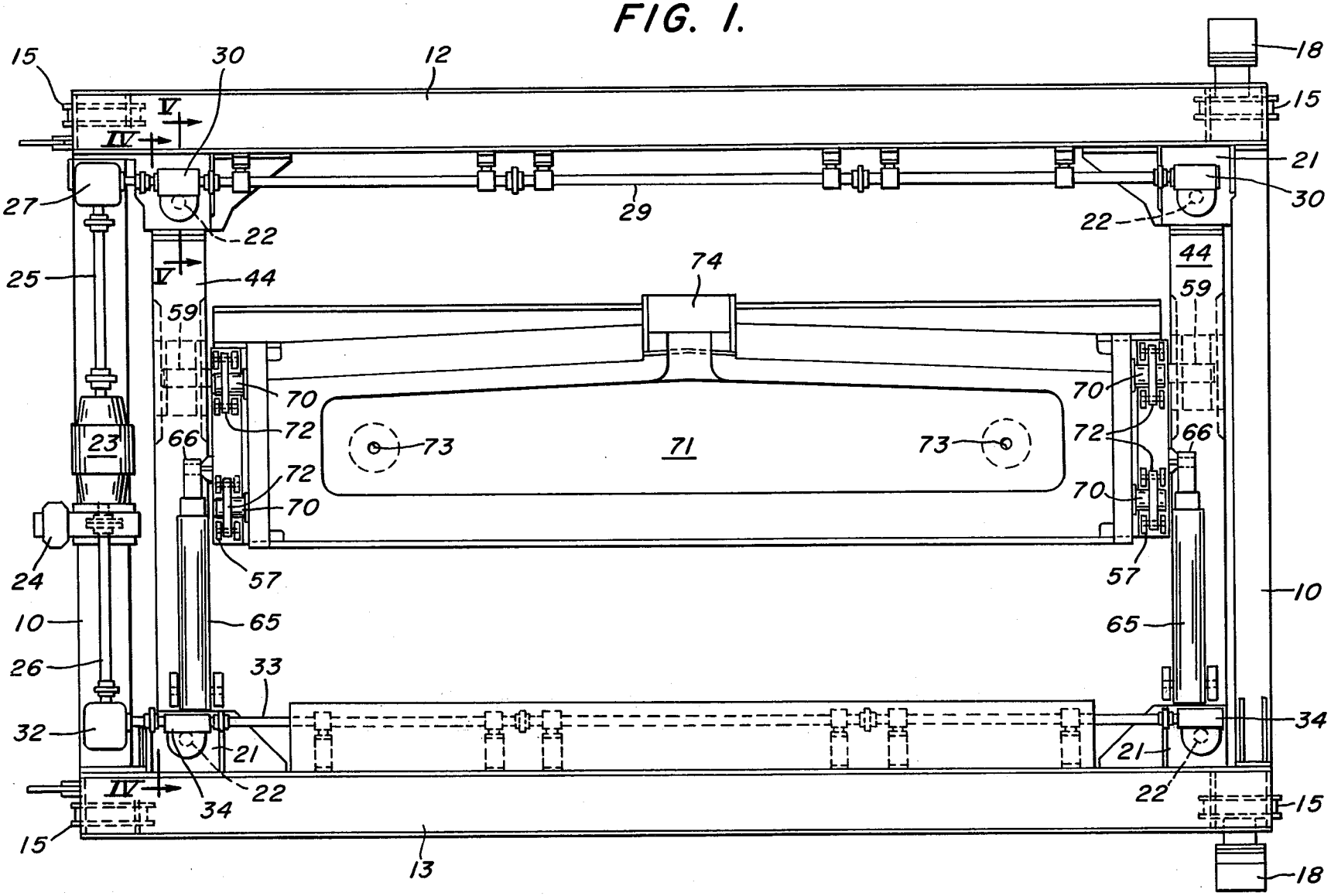
FIG. 1 is a top plan view of a tundish and tundish car constructed in accordance with the present invention.
Figure 2:
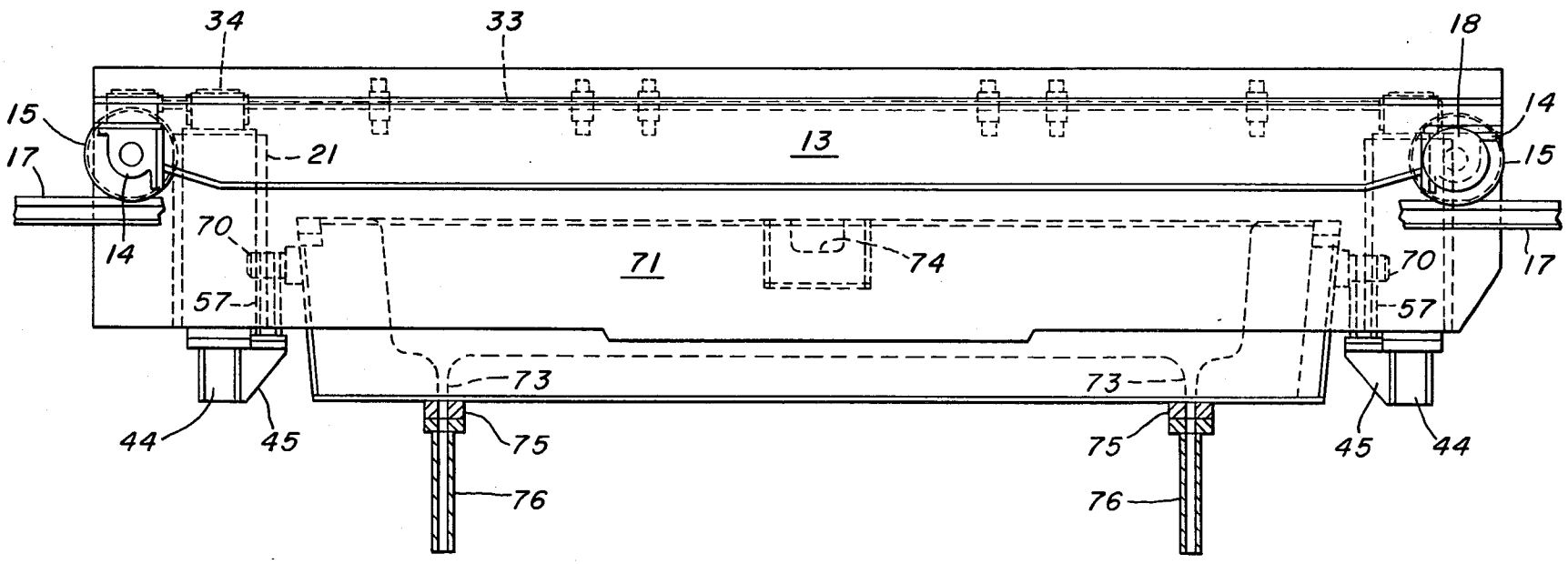
FIG. 2 is a side elevational view of the tundish and car.

The car of the present invention includes the usual frame formed of an opposed pair of transverse girders 10 and an opposed pair of low-side and high-side lengthwise frame members 12 and 13 rigidly interconnected. Frame members 12 and 13 carry bearings 14 (FIGS. 2 and 3) in which flanged wheels 15 are journaled to ride on low-side and high-side rails 16 and 17 on the casting floor. Two wheels at opposite sides of the car are driven by motors 18, preferably hydraulic, to propel the car along the rails (FIG. 1).

Figure 3:
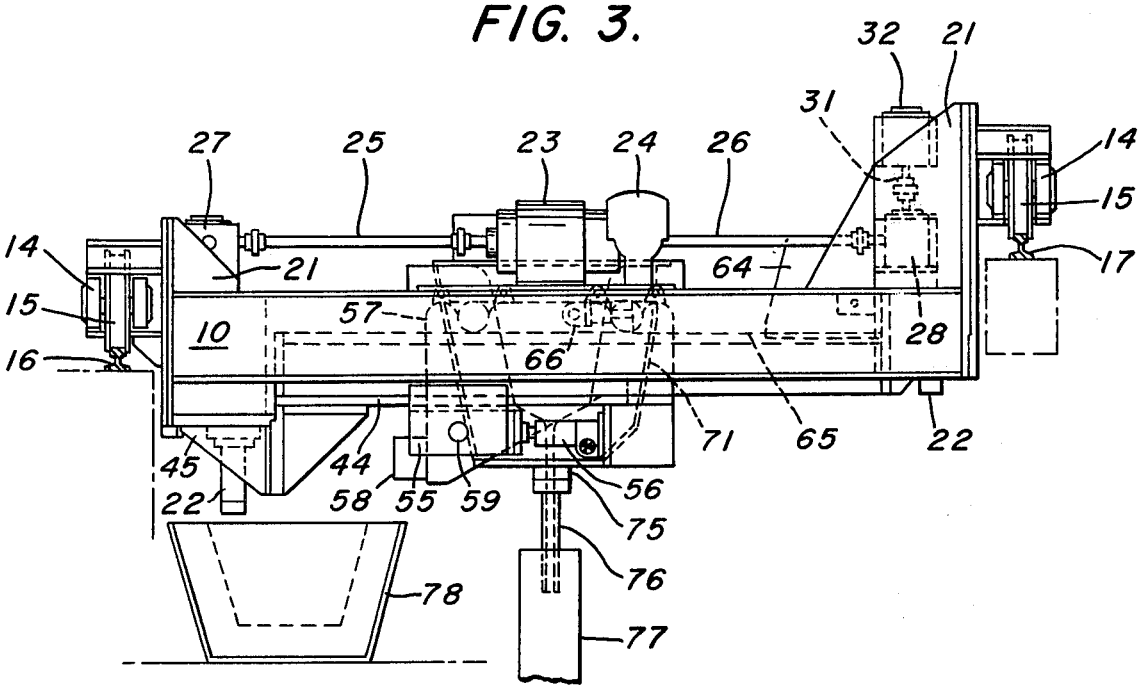
FIG. 3 is an end elevational view of the tundish and car.

The lengthwise frame members 12 and 13 carry housings 21 at their opposite ends fixed to their inside faces. Thus there are four housings 21 located near the respective corners of the frame. Each housing is square in cross section and extends vertically and contains a respective screw jack 22 suspended from the top, as more fully described hereinafter. The screw jacks are driven from a motor 23 which is mounted on one of the transverse girders 10 and preferably is equipped with an automatic brake 24. Moror 23 has transverse output shafts 25 and 26 extending toward the low and high sides respectively of the car. Shafts 25 and 26 lead to mitre gear boxes 27 and 28 (FIG. 3). A lengthwise line shaft 29 extends from the mitre gear box 27 and drives the two low-side screw jacks 22 through conventional worm gearing mounted within housings 30 at the upper ends of the screw jacks (FIG. 1). A vertical shaft 31 extends upwardly from the mitre gear box 28 at the high side of the car and leads to an upper mitre gear box 32 (FIG. 3). Another lengthwise line shaft 33 extends from the upper mitre gear box 32 and drives the two high-side screw jacks 22 through conventional worm gearing mounted within housings 34 at the upper ends of the screw jacks.

Figure 5:
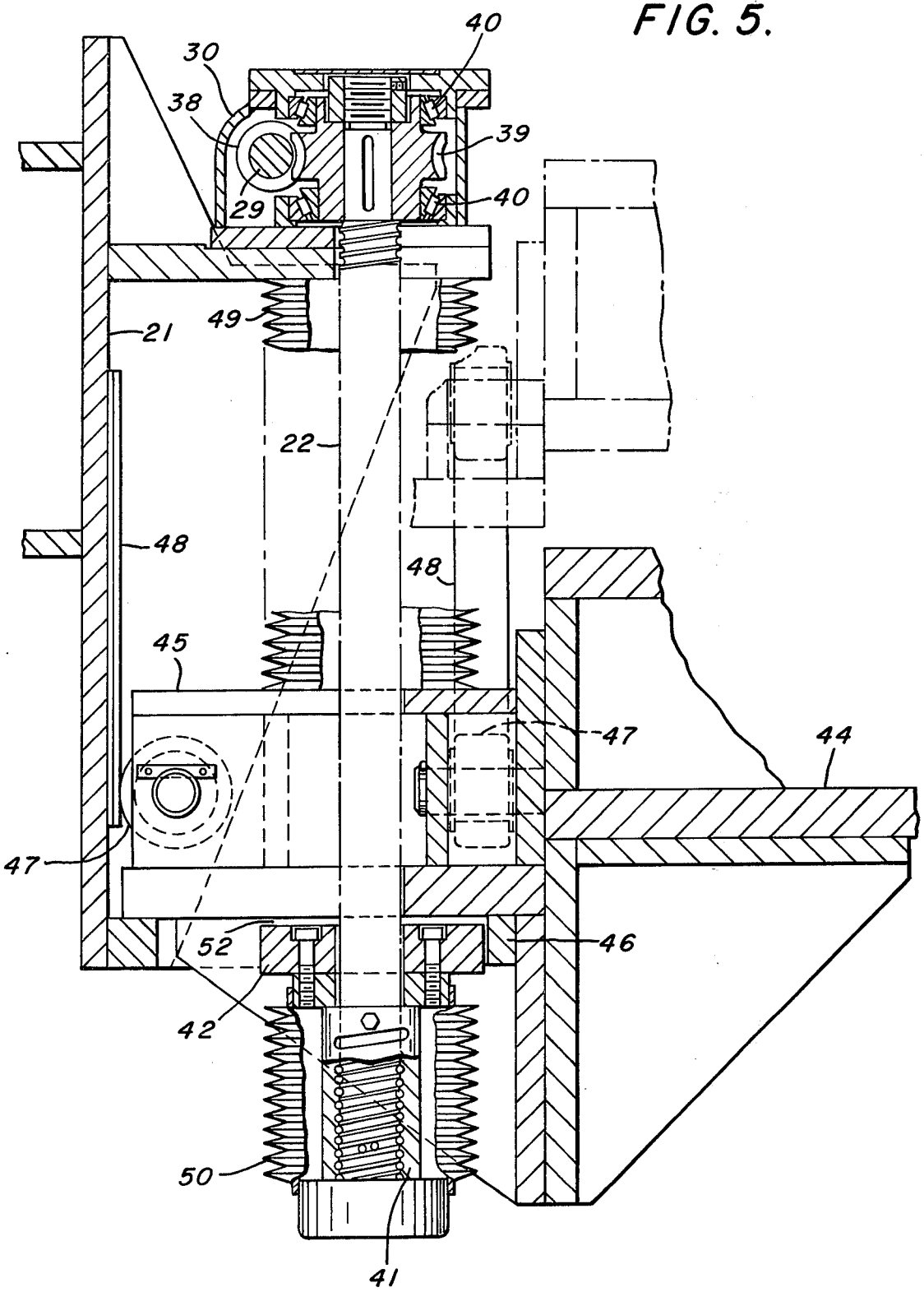
FIG. 5 is a vertical section on line V—V of FIG. 1.

FIG. 5 shows details of one of the low-side screw jacks 22; the others are similar. The worm gear housing 30 is fixed to the car frame at the top of the housing 21 and contains a worm 38 fixed to shaft 29, a cooperating worm gear 39, and thrust bearings 40 in which the worm gear is journaled. The screw jack 22 is fixed at its upper end to the worm gear and carries an internally threaded sleeve 41 which moves up or down as the screw jack rotates. A rectangular bearing plate 42 is fixed to the upper end of sleeve 41.

Figure 4:
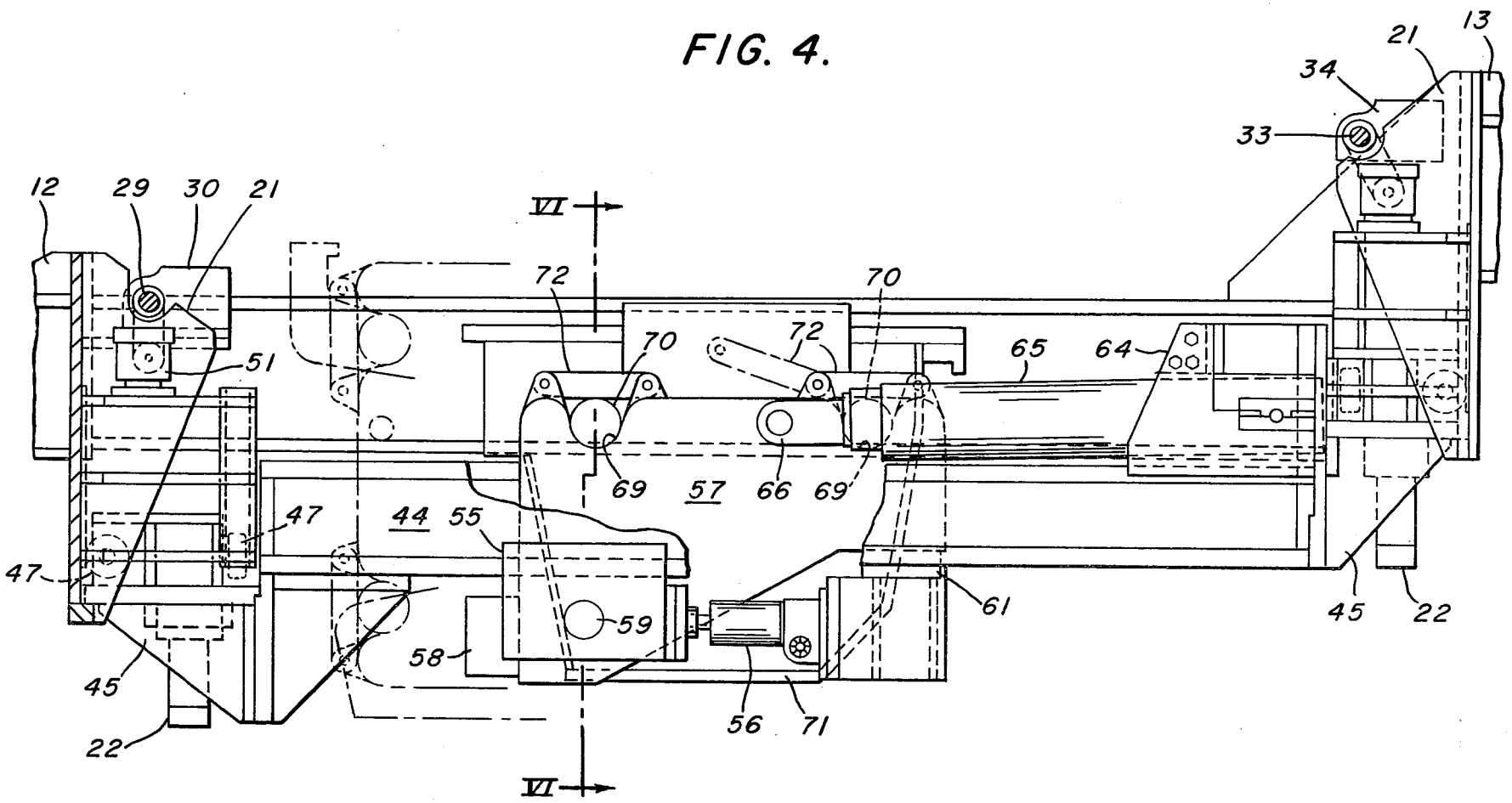
FIG. 4 is a vertical section on line IV—IV of FIG. 1.

As shown in FIG. 4, respective transverse lift beams 44 extend across opposite ends of the car and support the weight of a tundish as hereinafter explained. Respective carriages 45 are fixed to opposite ends of the lift beams and each extends into a different housing 21 for movement up and down within the housing. As shown in FIG. 5, the carriage 45 rests on a bar 46 when it is in its lowermost position. The carriage has rollers 47 which ride on vertically extending tracks 48 fixed within the housing 21. The carriage overlies the bearing plate 42, whereby it moves up or down when the screw jack 22 rotates. The screw jack is encased in upper and lower bellows 49 and 50 to exclude foreign matter. A limit switch 51 is operatively connected with shift 29 to prevent overtravel of carriage 45 (FIG. 4). When the carriage is in its lowermost position, there is a clearance 52 between the carriage and the bearing plate 42 to provide for operation of the limit switch.

With the construction described, the lift beams 44 in effect hang from the screw jacks 22. The weight of the tundish stresses the screw jacks in tension. Hence there is no tendency for the screw jacks to buckle under the load. This arrangement is an important feature of the present invention.

Figure 6:
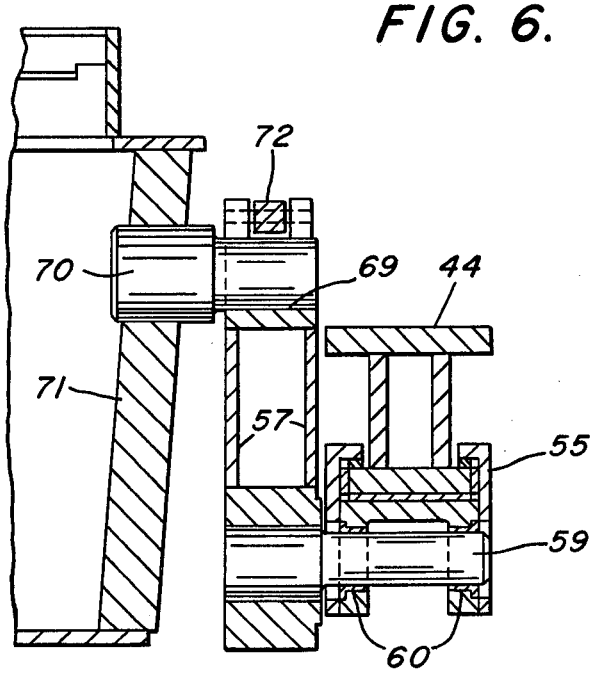
FIG. 6 is a vertical section on line VI—VI of FIG. 4.

The lift beams 44 carry respective hinge plates 55 at their inside faces (FIGS. 4 and 6). Plates 55 are horizontally adjustable in a direction transversely of the car. Hand operated screw jacks 56 are connected between the lift beams and the adjacent edges of the plates to effect such adjustment. A cradle formed of a pair of end walls 57 and a connecting bar 58 is pivotally attached to the hinge plates inside the respective lift beams at opposite ends of the car. The end walls 57 carry outwardly projecting pivot pins 59 received in bearings 60 carried by the hinge plates 55 (FIG. 6). The pivotal axis of the cradle extends horizontally and is situated near the bottom edges of its end walls 57 and toward the low side of the car. The lift beams carry inwardly projecting bearing plates 61 which the end walls 57 abut to support the cradle at the side remote from the pivot pins 59 as long as the cradle remains in its upright position.

The lift beams 44 carry respective upstanding brackets 64 adjacent the high side of the car. Respective fluid pressure cylinders 65 are pivoted to brackets 64 at opposite ends of the car. The cylinders contain respective reciprocable pistons and piston rods 66, the ends of which are pivoted to the end walls 57 of the cradle at the upper edges thereof.

The upper edge of each end wall 57 of the cradle has a pair of upwardly open sockets 69 to receive matching trunnions 70 on a tundish 71. Respective latch bars 72 are pivoted to the end walls 57 near each socket 69. The latch bars are movable to positions clear of the sockets 69 to enable a tundish to be placed within the cradle or removed therefrom, and to positions overlying the sockets to hold the tundish in the cradle. Tundish 71 has the usual teeming outlets 73 in its bottom wall and an overflow 74 in the upper edge of its side wall at the low side of the car. The tundish is equipped with conventional slidable gates 75 and pouring tubes 76, shown diagrammatically in FIG. 2, for controlling discharge of metal through the outlets 73. A mold 77 of a continuous casting machine and a receptacle 78 for receiving material from the overflow are shown diagrammatically in FIG. 3.

In operation, a preheated tundish 71 is supported on the cradle 57, 58 in an upright position with the trunnions 70 received in sockets 69 and latched therein. The car is moved along rails 16 and 17 to a position in which the tundish is over the mold 77 for teeming into the mold. The hand operated screw jacks 56 are adjusted to center the pouring tubes 76 with respect to the width of the mold. The screw jacks 22 are operated to lower the tundish to its teeming position. Liquid metal is introduced to the tundish from a ladle (not shown) and can be teemed therefrom into the mold. Whenever it becomes necessary to change pouring tubes, the screw jacks 22 are operated to raise the tundish, and the change made in the usual manner.

Whenever it is necessary to dump the contents of the tundish, the screw jacks 22 are operated to raise the cradle and tundish, and cylinders 65 are operated to project their piston rods 66. This tilts the cradle and tundish from their upright position about the axis of the pivot pins 59 toward the low side of the car, and the material discharges from the overflow 74 into the receptacle 78. The axis about which the cradle and tundish pivots is off-center near the bottom of the tundish and adjacent the side toward which the cradle tilts. Hence the overflow of the tilted tundish is clear of the mold and in a position where the contents enter the receptacle 78. The cylinders are operated to retract the piston rods to return the cradle and tundish to their normal upright position.

From the foregoing description it is seen that the present invention provides a tundish car which enables a tundish carried thereon to tilt from its upright position about an off-center axis located near the bottom of the tundish and adjacent the side to which the contents are dumped. This location of the pivotal axis not only assures that the contents are dumped clear of the mold, but also minimizes the force necessary to tilt the tundish. Hence it is unnecessary to shift the car from its position for teeming in order to dump the contents. The car affords the added advantage of greater stability since the weight of the tundish and its contents apply tensile forces to the screw jacks. It is also apparent that the tilting mechanism of the present invention can be used with cars which have different forms of raising and lowering mechanism from that shown.

I claim:

1. In a tundish car which comprises:

a frame formed of transverse members and low-side and high-side longitudinal members fixed at opposite ends of said transverse members;

a pair of opposed transverse lift beams adjacent the respective transverse members of said frame; and means carried by said frame operatively connected with said lift beams for supporting and raising and lowering them, the combination therewith of an improved mechanism for supporting a tundish and tilting it to dump its contents, said mechanism comprising:

a cradle having a pair of end walls and longitudinal means connecting said end walls;

means pivotally supporting said cradle on said lift beams on an off-center axis nearer said low-side longitudinal member and near the lower edge of the end walls;

means on said cradle for receiving and supporting a tundish; and motive means pivoted to aid lift beams near said high-side longitudinal member and to said end walls near the upper edges thereof for tilting said cradle and a tundish carried thereby from an upright position toward said low-side longitudinal member.

2. A car as defined in claim 1 in which the means supporting said lift beams includes a plurality of screw jacks supported on said frame, and means operatively connecting said screw jacks with said lift beams to carry the weight of the lift beams, cradle, and tundish with the screw jacks stressed in tension.

3. A car as defined in claim 1 in which said tundish-receiving and supporting means includes a respective pair of spaced-apart sockets in the upper edge of each of said end walls to receive corresponding trunnions on the tundish, and latch means on said end walls for retaining the trunnions in the sockets.

4. A car as defined in claim 1 in which the means pivotally supporting said cradle include hinge plates adjustable horizontally transversely of said frame, said car including screw jacks operatively connected with said hinge plates for effecting adjustment thereof.

5. In a continuous-casting installation which includes a mold, a tundish car for positioning a tundish over said mold to teem liquid metal into the mold, and a receptacle adjacent said mold into which the contents of the tundish may be dumped, said car comprising:

a frame formed of transverse members, a low-side longitudinal member on the side adjacent said receptacle, and a high-side longitudinal member on the opposite side, said members being fixidly connected;

a pair of opposed transverse lift beams adjacent the respective transverse members of said frame; and means carried by said frame operatively connected with said lift beams for supporting and raising and lowering them;

the combination with said car of an improved mechanism for supporting a tundish and tilting it to dump its contents into said receptacle, said mechanism comprising:

a cradle having a pair of end walls and longitudinal means connecting said end walls;

means pivotally supporting said cradle on said lift beams on an off-center axis nearer said low-side longitudinal member and near the lower edge of said end walls;

means on said cradle for receiving and supporting a tundish; and motive means pivoted to said lift beams near said high-side longitudinal member and to said end walls near the upper edges thereof for tilting said cradle and a tundish carried thereby from an upright position toward said receptacle to dump while the car remains in its position for teeming.

* * * * *